US010179394B2

(12) United States Patent
Souris et al.

(10) Patent No.: US 10,179,394 B2
(45) Date of Patent: Jan. 15, 2019

(54) TOGGLE CLAMP WITH LOCKING MECHANISM

(71) Applicant: Lapeer Manufacturing Company, Lapeer, MI (US)

(72) Inventors: Nicholas Theodore Souris, Shelby Township, MI (US); Daniel L. Stock, Lapeer, MI (US); Brian Michael Bousson, Sterling Heights, MI (US)

(73) Assignee: Lapeer Manufacturing Company, Lapeer, MI (US)

( * ) Notice: Subject to any disclaimer, the term of this patent is extended or adjusted under 35 U.S.C. 154(b) by 0 days.

(21) Appl. No.: 15/138,363

(22) Filed: Apr. 26, 2016

(65) Prior Publication Data

US 2016/0318157 A1 Nov. 3, 2016

Related U.S. Application Data

(60) Provisional application No. 62/153,560, filed on Apr. 28, 2015.

(51) Int. Cl.
*B25B 5/12* (2006.01)
*B25B 5/16* (2006.01)

(52) U.S. Cl.
CPC . *B25B 5/16* (2013.01); *B25B 5/12* (2013.01)

(58) Field of Classification Search
CPC ... B25B 5/12; E05B 15/0046; E05B 15/0053; E05B 15/006; E05B 17/2019
See application file for complete search history.

(56) References Cited

U.S. PATENT DOCUMENTS 1,002,901 A * 9/1911 Christman ..... B60P 7/0838 24/68 CD
2,386,567 A * 10/1945 Olson ..... B25B 5/12 269/221

(Continued)

FOREIGN PATENT DOCUMENTS

EP 1413398 A2 * 4/2004 ..... B25B 5/12
JP 3174166 U 3/2012
JP 2015000464 A 1/2015

OTHER PUBLICATIONS

International Search Report and Written Opinion dated Aug. 10, 2016 regarding PCT/US2016/029719.

(Continued)

*Primary Examiner* — Tyrone V Hall, Jr.
(74) *Attorney, Agent, or Firm* — Harness, Dickey & Pierce, P.L.C.

(57) ABSTRACT

A toggle clamp locking mechanism for selectively coupling a work piece. The mechanism includes a base structure; a primary locking system movement between a retaining position and a release position, the primary locking system having a handle member pivotally coupled to the base structure, an action for engaging the workpiece in the retaining position and releasing the workpiece in the release position, and a linkage system mechanically interconnecting the handle member with the action. A second locking system having an engagement member is provided having a cam follower cammingly engaging a first detent when the primary locking system is in the retaining position preventing the primary locking system from moving from the retaining position. The second locking system is actuatable to disengage the cam follower from the first detent to enable movement of the primary locking system to move from the retaining position.

26 Claims, 5 Drawing Sheets

(56) References Cited

U.S. PATENT DOCUMENTS

| | | | | | |
|---|---|---|---|---|---|
| 2,439,483 | A * | 4/1948 | Merriman | B25B 5/12 | 269/221 |
| 3,035,831 | A * | 5/1962 | Blatt | B25B 5/12 | 24/513 |
| 3,346,929 | A * | 10/1967 | Webb | B64C 1/30 | 24/494 |
| 4,141,543 | A * | 2/1979 | Kato | B25B 1/14 | 269/228 |
| 4,331,326 | A * | 5/1982 | Strouss | B25B 5/12 | 269/157 |
| 4,793,225 | A * | 12/1988 | Berkich | B25B 5/12 | 81/176 |
| 5,165,148 | A * | 11/1992 | Fleischer | B25B 5/12 | 24/494 |
| 5,527,014 | A * | 6/1996 | Bracewell | B66F 19/00 | 254/15 |
| 5,527,024 | A * | 6/1996 | Dysktra | B25B 5/12 | 269/228 |
| 6,158,729 | A * | 12/2000 | Tsai | B25B 5/12 | 269/136 |
| 6,595,507 | B2 | 7/2003 | Dykstra | | |
| 6,932,335 | B1 | 8/2005 | Dykstra | | |
| 7,648,131 | B2 * | 1/2010 | Hagan | B25B 5/12 | 269/201 |
| 9,440,318 | B1 * | 9/2016 | Tibbets | B25B 27/02 | |
| 2007/0267799 | A1 | 11/2007 | Dykstra | | |
| 2010/0148414 | A1 | 6/2010 | Poole et al. | | |

OTHER PUBLICATIONS

International Preliminary Report on Patentability dated Nov. 9, 2017 regarding PCT/US2016/029719.

* cited by examiner

TOGGLE CLAMP WITH LOCKING MECHANISM

CROSS-REFERENCE TO RELATED APPLICATIONS

This application claims the benefit of U.S. Provisional Application No. 62/153,560, filed on Apr. 28, 2015. The entire disclosure of the above application is incorporated herein by reference.

FIELD

The present disclosure relates to toggle clamps and, more particularly, relates to toggle clamps having a locking mechanism.

BACKGROUND

This section provides background information related to the present disclosure which is not necessarily prior art.

Toggle clamps are used for a variety of purposes, such as retaining and/or fixturing a work piece. A conventional toggle clamp comprises a clamp body that can be fastened to a work station or other supporting structure. A retaining arm is pivotally coupled to the clamp body to permit articulation of the retaining arm relative to the generally-stationary clamp body. A hold down member can extend from a distal end of the retaining arm and operably engage the work piece. A handle member is further pivotally coupled to the clamp body and operably engages the retaining arm to articulate the retaining arm between a raised and disengaged position (e.g. release position) and a lowered and engaged position (e.g. retaining position). The lowered and engaged position engaging the work piece to retain and/or fixture the work piece in position.

Conventional toggle clamps can include a variety of handles structures, including elongated members and the like, and a variety of configurations, including vertical or horizontal-handle Hold-Down style clamps. Conventional toggle clamps can further include push-pull, push-pull drawbar, hook, and latch type linear actuating clamps. Many of these configurations are offered in heavy duty configurations for some applications.

Generally, toggle clamps are a quick-acting mechanical linkage with three basic elements—an action, a linkage, and a handle or actuator. During operation, the clamp is first moved into position to contact the work piece and then actuated to apply a clamping force. This clamping force is generated by compressing or stretching the linkage elements.

In some cases, conventional toggle clamps can include a locking mechanism. In conventional toggle clamps, the locking mechanism can be engaged by moving a center pivot of the toggle action past the centerline of two other pivots, against a stop. The lock achieved by the movement of the center pivot past centerline is referred to as the "toggle lock." However, conventional toggle locks have at least two primary disadvantages. The first disadvantage is that heavy vibration or impact can cause the center pivot to move from its past center position and, thus, "unlock" the mechanism. The second disadvantage, and potentially more prevalent, is that the clamp can be inadvertently actuated by inadvertent contact with the actuator.

For these and other reasons, some toggle clamps include a secondary locking mechanism that must be activated before the clamp mechanism itself can be actuated. The vast majority of these secondary locking mechanisms fall into two categories. The first involves the base clamp components remaining essentially unchanged from its typical configuration and the secondary locking mechanism being simply added on in some way that restricts normal operation of the clamp until it has been activated. In the second, some of the clamps primary components have been altered from the base model, but the lock functions via a wedging or jamming action as opposed to a true locking action. In some applications, these locking mechanisms, or secondary locks, must be actuated in a clumsy or awkward action by the operator.

Although this arrangement may be useful for some applications, it has been found that they often fail to provide a simple and consistent locking method. In fact, in many cases, these conventional secondary locking mechanisms are less reliable and can be overcome with moderate force. Frequently they require the operator to activate them though a clumsy or awkward action that cannot be integrated into the normal and deliberate clamp activation. For example, if the clamp is normally activated by a left to right motion of the operators hand along the linear axis of the clamp, the secondary locking mechanism may require a pushing or pulling motion perpendicular to the long axis before the primary activation motion can be initiated. In many cases, they only allow the clamp to be locked in a single position, usually closed.

Accordingly, there exists a need in the relevant art to provide a toggle clamp that overcomes the deficiencies of conventional toggle clamp designs. Moreover, there exists a need in the relevant art to provide a toggle clamp that provides a suitable, robust locking mechanism that can retain the handle member and/or retaining arm in both a release and retaining position.

SUMMARY

This section provides a general summary of the disclosure, and is not a comprehensive disclosure of its full scope or all of its features.

According to the principles of the present teachings, a toggle clamp is provided for retaining a work piece. The toggle clamp includes a base structure, a primary clamp handle pivotally coupled to the base structure, an action for engaging a work piece, a linkage system mechanically interconnecting the primary clamp handle with the action, and a locking system having a locking lever and a clamp link. The locking lever is pivotally coupled to the primary clamp handle at a first end and includes a pin extending from an opposing second end. The clamp link is pivotally coupled to the action at a first end and includes a pair of notches and a cam surface at an opposing second end. The cam surface is disposed between the pair of notches. The pin of the locking lever is configured to be lockingly received with at least one of the pair of notches to define a locked configuration of the primary clamp handle. The pin is operable to cammingly engage the cam surface during movement between the pair of notches.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
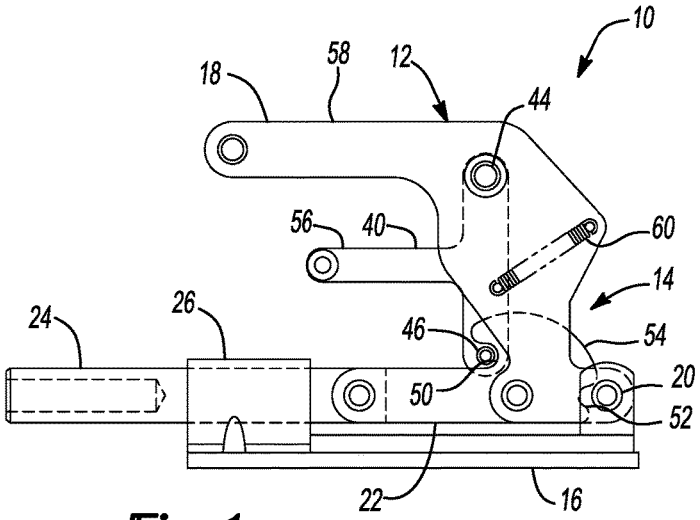
FIG. 1 is a side view of a toggle clamp locking mechanism having a pivoting engagement member, in a retaining position, according some embodiments of the present invention.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

According to the principles of the present invention, a toggle clamp locking mechanism 10 is provided having a primary locking system 12 for retaining or fixturing a workpiece and a secondary locking system 14 for retaining primary locking system 12 in at least a retaining position. In some embodiments, secondary locking system 14 can further retain primary locking system 12 in a release position.

Figure 2:
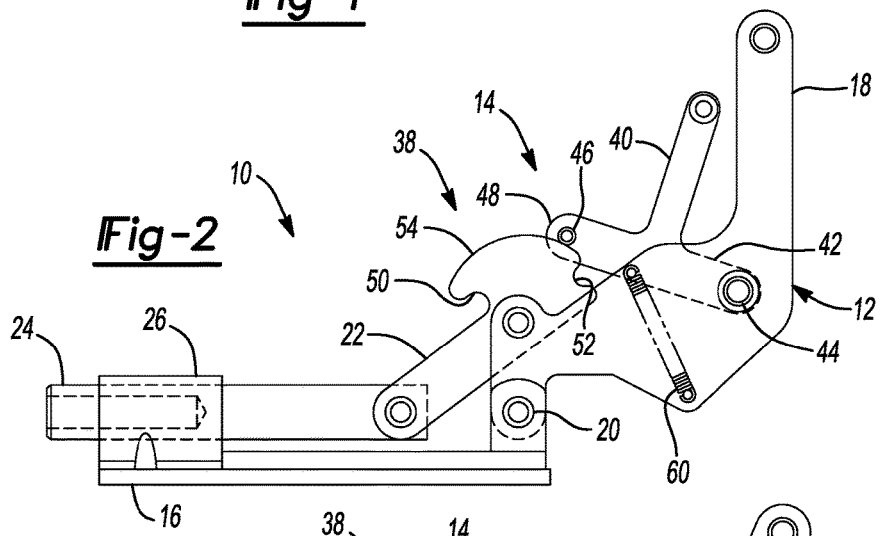
FIG. 2 is a side view of the toggle clamp locking mechanism of FIG. 1 in an intermediate position.
Figure 3:
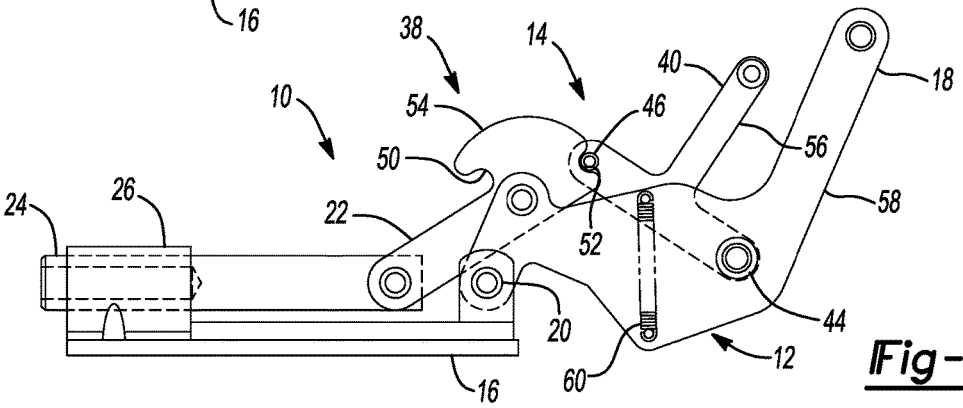
FIG. 3 is a side view of the toggle clamp locking mechanism of FIG. 1 in a release position.
Figure 5:
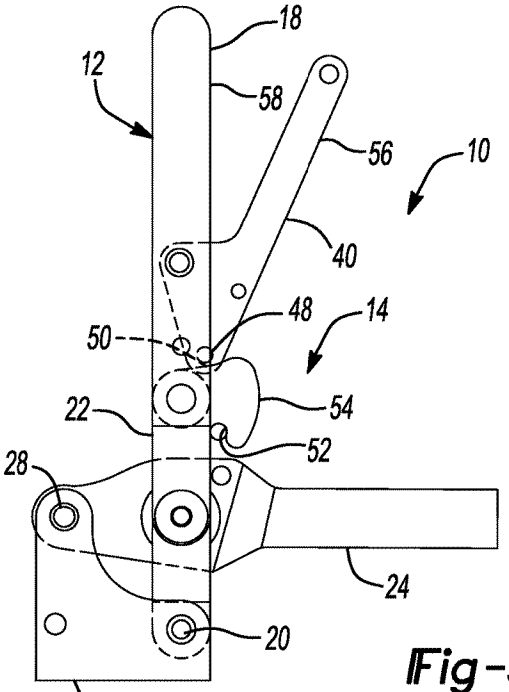
FIG. 5 is a side view of the toggle clamp locking mechanism of FIG. 4 in a retaining position.
Figure 4:
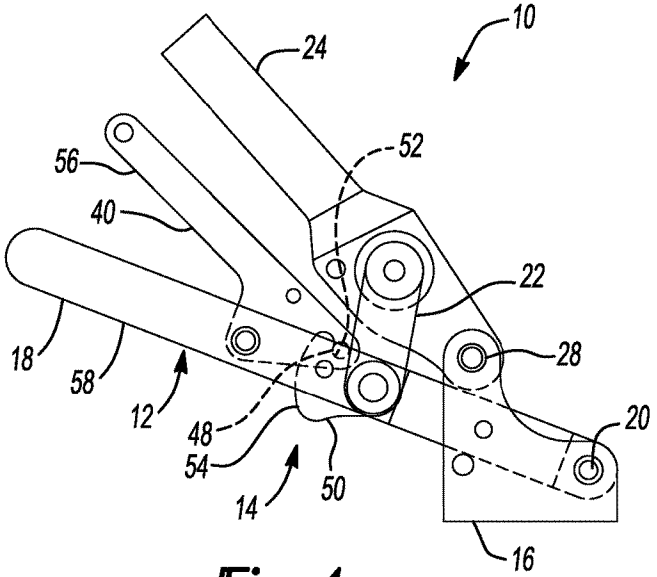
FIG. 4 is a side view of a toggle clamp locking mechanism having a pivoting engagement member according some embodiments of the present invention in a release position.
Figure 6:
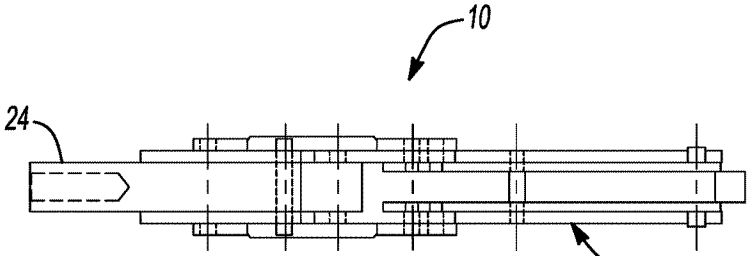
FIG. 6 is a top view of a toggle clamp locking mechanism having a pivoting engagement member according some embodiments of the present invention.
Figure 7:
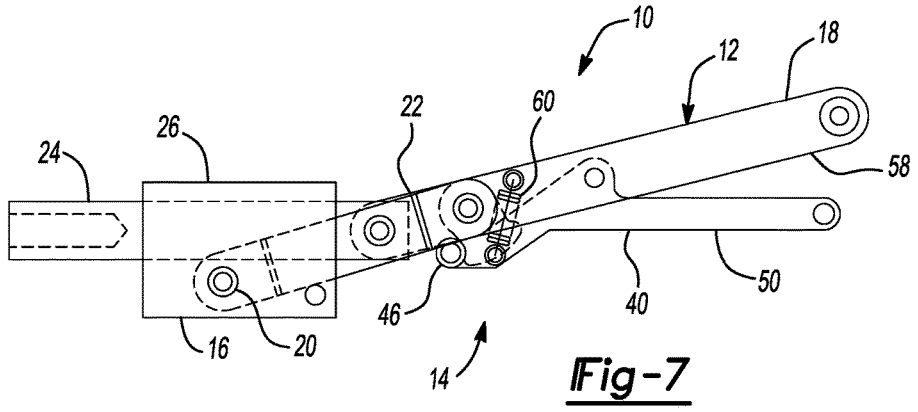
FIG. 7 is a front view of the toggle clamp locking mechanism of FIG. 6 in a release position.
Figure 8:
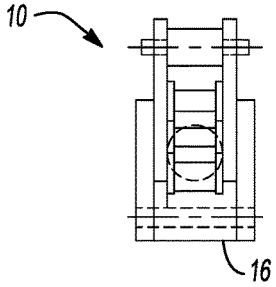
FIG. 8 is an end view of the toggle clamp locking mechanism of FIG. 6.
Figure 10:
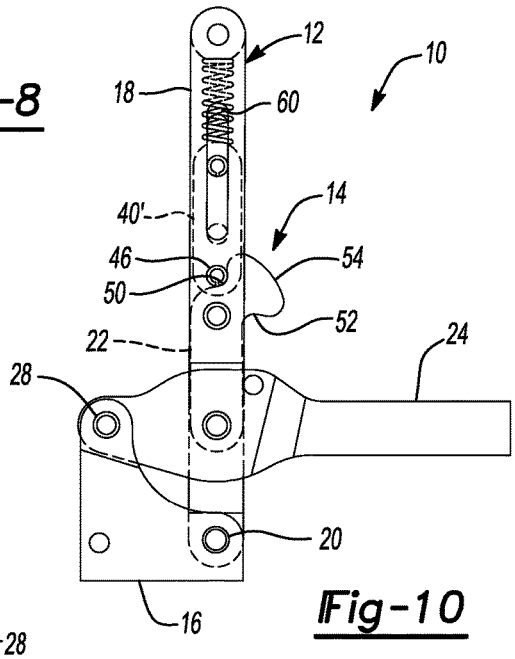
FIG. 10 is a side view of the toggle clamp locking mechanism of FIG. 9 in a retaining position.
Figure 9:
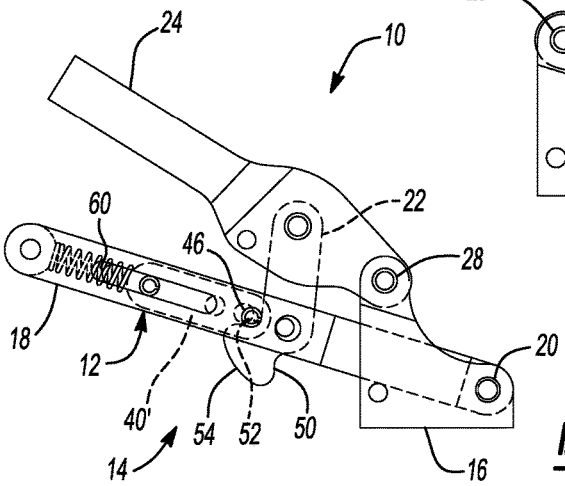
FIG. 9 is a side view of a toggle clamp locking mechanism having a linear engagement member according some embodiments of the present invention in a release position.
Figure 11:
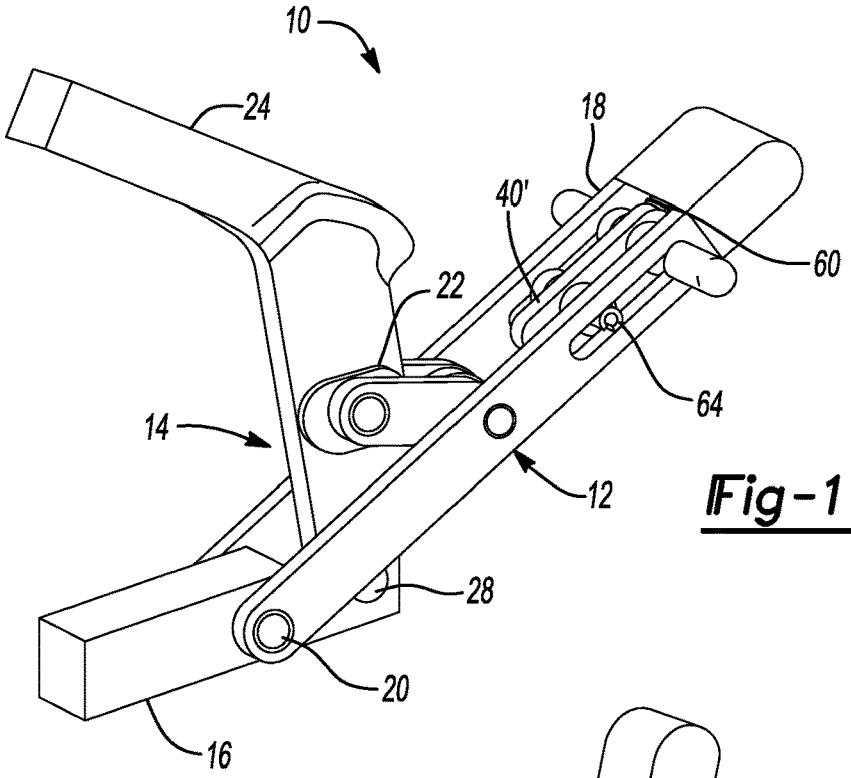
FIG. 11 is a perspective view of a toggle clamp locking mechanism having a linear engagement member according some embodiments of the present invention in a release position.
Figure 12:
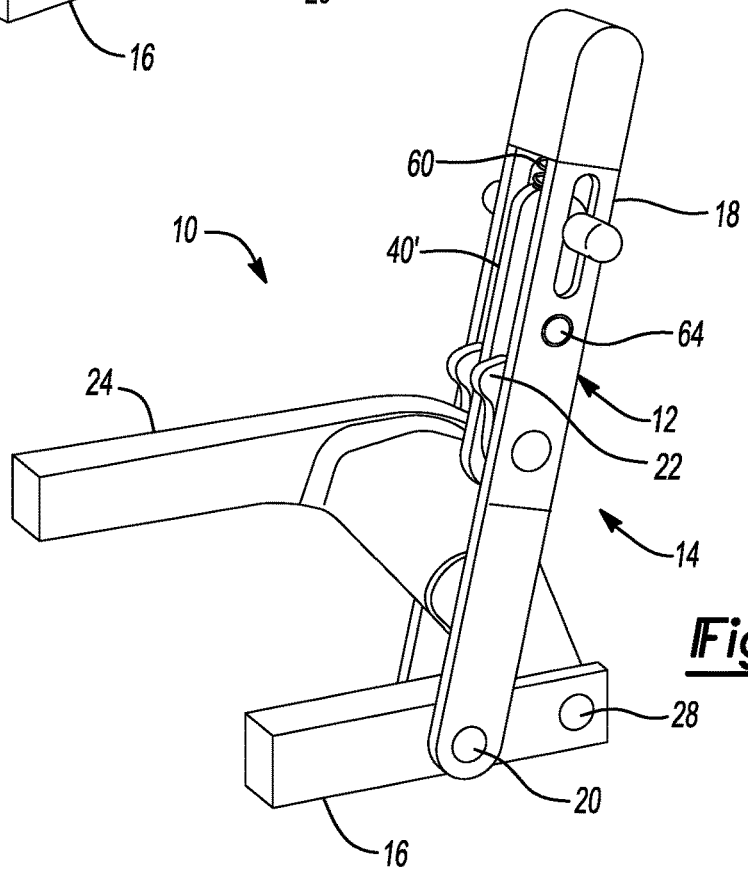
FIG. 12 is a perspective view of the toggle clamp locking mechanism of FIG. 11 in a retaining position.
Figure 13:
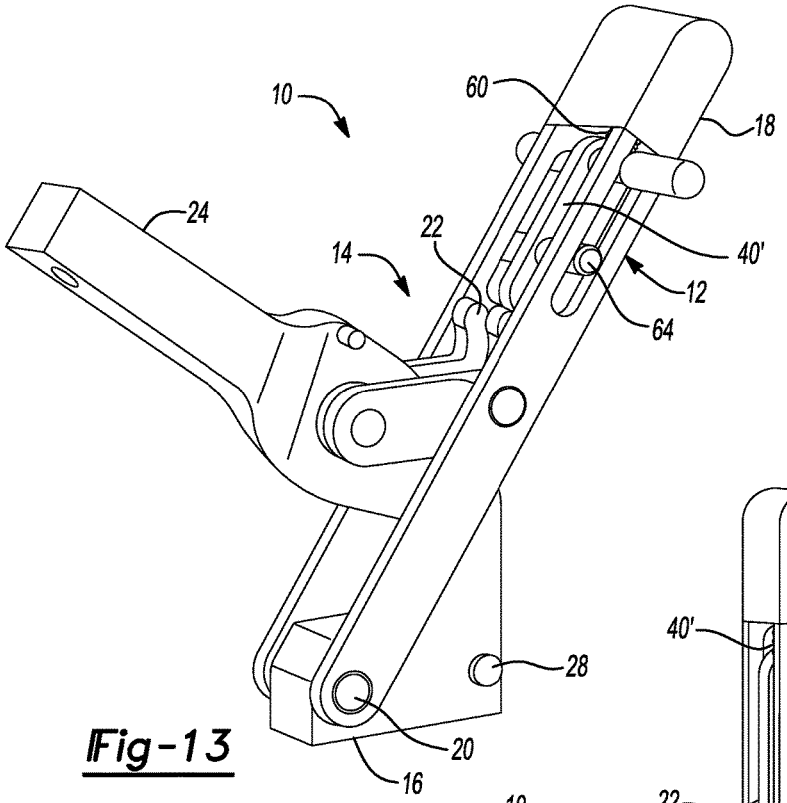
FIG. 13 is a perspective view of a toggle clamp locking mechanism having a linear engagement member according some embodiments of the present invention in a release position.
Figure 14:
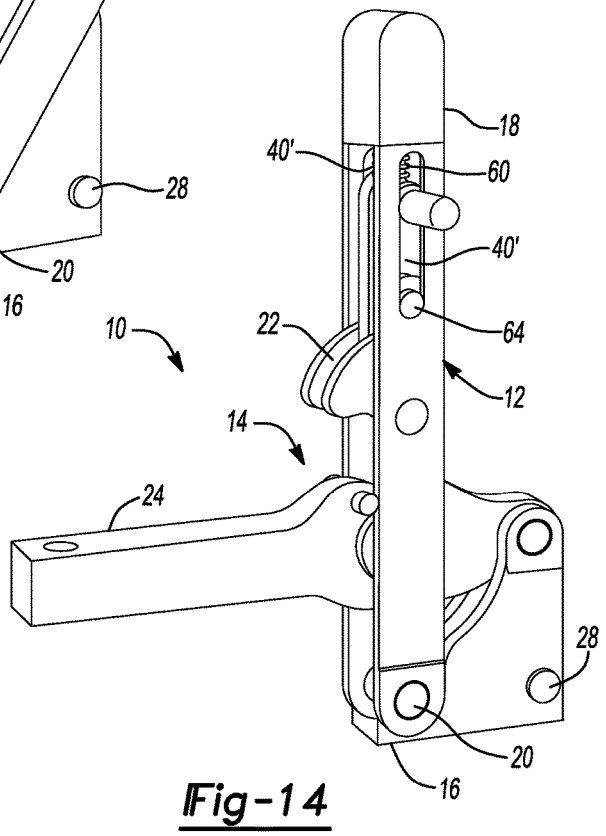
FIG. 14 is a perspective view of the toggle clamp locking mechanism of FIG. 13 in a retaining position.

In some embodiments, as illustrated in FIGS. 1-3, toggle clamp locking mechanism 10 can comprise a base structure 16 connectable to a work station or other supporting structure. A handle member 18 is pivotally coupled to base structure 16 at a pivot 20. Handle member 18 is pivotable about pivot 20 between a retaining position retaining a workpiece (not shown) (see FIGS. 1, 5, 7, 10, 12, and 14) and a release position releasing a workpiece (see FIGS. 3, 4, 9, 11, and 13). Toggle clamp locking mechanism 10 can further comprise a clamp link 22 operably coupled between handle member 18 and a clamp 24. Clamp 24 can be configured to retain a workpiece retaining implement (not shown) using conventional fastening means, such as threaded fasteners and the like. Moreover, clamp 24 can comprise a toggle bar, spindle, hook, u-bar or other element. Clamp 24 can be part of any one of a number of conventional actions for engaging workpieces. In some embodiments, clamp link 22 can operably engage clamp 24 to permit linear translation of clamp 24 (see FIGS. 1-3 and 6-8) or pivotal translation of clamp 24 (see FIGS. 4-5 and 9-14). In some embodiments employing linear translation of clamp 24, base structure 16 can comprise a feature or sleeve 26 for supporting clamp 24 to permit translation of clamp 24 along a single axis. In this way, pivotal movement of handle member 18 between the retaining position and the release position is translated along clamp link 22 into linear translation of clamp 24. Similarly, in some embodiments employing pivotal translation of clamp 24, clamp 24 can be pivotally coupled to base structure 16 at pivot 28. In this way, pivotal movement of handle member 18 between the retaining position and the release position is translated along clamp link 22 into pivotal movement of clamp 24.

It should be understood that handle member 18 can define any one of a number of shapes and contours that are specific to a particular use, application, or desired ergonomics. Generally, however, handle member 18 can comprise a handle section 30 to be gripped and/or actuated by an operator. As will be appreciated from the discussion herein, secondary locking system 14 is configured to be actuated by an operator in a natural and convenient relation to actuation of handle member 18 of primary locking system 12. In some embodiments, handle member 18 can define an orthogonal section disposed at an angle relative to a main section (see FIGS. 1-3) or can define a generally elongated member (see FIGS. 4-14). In either configuration, handle member 18 is configured to provide sufficient mechanical advantage to permit an operator to conveniently actuate primary locking system 12 to retain and release the workpiece in a safe and reliable manner.

According to the principles of the present teachings, secondary locking system 14 is employed to permit safe retention of the primary locking system 12 in at least the retaining position, and, in some embodiments, permit safe retention of the primary locking system 12 in the release position. This permits that toggle clamp locking mechanism 10 to be safely locked in the retaining position and/or release position and provide a suitable, robust locking mechanism that can retain the handle member and/or retaining arm in both a release and retaining position.

In some embodiments, secondary locking system 14 comprises an engagement member 40 that cammingly engages a corresponding detent and cam system 38 disposed on clamp link 22. It should be understood that engagement member 40 can comprise any one of a number of shapes and deployment systems; however, each engagement member 40 is configured to engage a detent formed on clamp link 22 to retain primary locking system 12 in the retaining position and/or retention position.

In some embodiments, as illustrated in FIGS. 1-3, engagement member 40 can comprise a generally T-shaped member having a first end 42 pivotally coupled to handle member 18 at pivot 44. Engagement member 40 can further comprise a cam follower 46 extending from an opposing end 48. Cam follower 46 is sized and shaped to be captured within a first detent 50 formed in clamp link 22 when handle member 18 is in the retaining position (see FIG. 1) and a second detent 52 formed in clamp link 22 when handle member 18 is in the release position (see FIG. 3). During actuation of toggle clamp locking mechanism 10 between the retaining position and the release position, cam follower 46 is configured to ride along a cam surface 54 extending between first detect 50 and second detent 52. Therefore, when cam follower 46 is disposed within first detent 50, handle member 18 is locked in the retaining position preventing inadvertent release of toggle clamp locking mechanism 10 causing release of the workpiece. Likewise, when cam follower 46 is disposed within second detent 52, handle member 18 is locked in the release position preventing inadvertent closure of toggle clamp locking mechanism 10 upon the workpiece or operator. Cam surface 54 provides, at least in part, a smooth transition for cam follower 46 from first detent 50 to second detent 52. Engagement of cam follower 46 within first detent 50 and/or second detent 52 results in primary locking system 12 resisting actuation between the retaining position and the release position (and vice versa).

With continued reference to FIGS. 1-3, in some embodiments engagement member 40 can comprise a gripping portion 56 configured to be actuated by the operator. In some embodiments, gripping portion 56 can comprise an elongated handle extending orthogonally from engagement member 40 between ends 42 and 48. Gripping portion 56 can be shaped to be positioned adjacent a gripping portion 58 of handle member 18 in both the retaining position (FIG. 1) and the release position (FIG. 3).

In some embodiments, as illustrated in FIGS. 1-3, 7, and 9-14, engagement member 40 can be biased via a biasing member 60 (e.g. spring) to engage cam follower 46 within first detent 50 and second detent 52. It should be understood that any biasing member can be used in any of the illustrated embodiments. Moreover, it should be understood that alternative systems are envisioned.

With particular reference to FIGS. 4-8, it should be understood that in some embodiments engagement member 40 can be alternatively shaped to define a cantilevered shape pivotally coupled to handle member 18 at a midpoint location (rather than an end location of FIGS. 1-3). In this way, an operator can benefit from mechanical advantage/leverage to actuate cam follower 46 between first detent 50 and second detent 52. This configuration does not depart from the common configuration of engagement member 40 engaging a first detent 50 and second detent 52 formed on clamp link 22.

In some embodiments, as illustrated in FIGS. 9-14, engagement member 40 can be elongated and actuated along a linear direction (rather than a pivotal direction of FIGS. 1-8), hereinafter referenced as engagement member 40'. In some embodiments, engagement member 40' is disposed within an interior portion of handle member 18, however this should not be regarded as a requirement unless other claimed. Engagement member 40' can be actuated via one or more gripping portions or members 56' extending therefrom. In some embodiments, gripping portions 56' can extend through engagement member 40' and be fixedly coupled therewith. Gripping portions 56' can be captured within slots 62 formed in handle member 18. Similarly, guide posts 64 can extend from engagement member 40' and be captured within slots 62 thereby forming pins permitting linear translation of engagement member 40'. Cam follower 46 of engagement member 40' can engage first detent 50, second detent 52, and cam surface 54 as described herein. Engagement member 40' can be similarly biased into engagement with first detent 50, second detent 52, and cam surface 54 by biasing member 60.

During operation, an operator can actuate toggle clamp locking mechanism 10 from a retaining position to a release position by simultaneously grasping engagement member 40, 40' and handle member 18, thereby releasing cam follower 46 from first detent 50 of secondary locking system 14. Handle member 18 is then pivoted about pivot 20 thereby causing clamp link 22 to actuate clamp 24 from the retaining position to the release position. During this movement, engagement member 40, 40' can be released thereby permitting cam follower 46 to cammingly engage cam surface 54. Upon reaching the release position, cam follower 46 can biasingly engage second detent 52 thereby locking toggle clamp locking mechanism 10 in the release position.

Likewise, an operator can actuate toggle clamp locking mechanism 10 from the release position to the retaining position by simultaneously grasping engagement member 40, 40' and handle member 18, thereby releasing cam follower 46 from second detent 52 of secondary locking system 14. Handle member 18 is then pivoted about pivot 20 thereby causing clamp link 22 to actuate clamp 24 from the release position to the retaining position. During this movement, engagement member 40, 40' can be released thereby permitting cam follower 46 to cammingly engage cam surface 54. Upon reaching the retaining position, cam follower 46 can biasingly engage first detent 50 thereby locking toggle clamp locking mechanism 10 in the retaining position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A toggle clamp for selectively coupling a work piece, the toggle clamp comprising:

a base structure;

a primary locking system configured to be movable between a retaining position and a release position, the primary locking system having a handle member pivotally coupled to the base structure, a clamp for engaging the workpiece in the retaining position and releasing the workpiece in the release position, and a linkage system mechanically interconnecting the handle member with the clamp, the linkage system being pivotally coupled to each of the handle member and the clamp; and a second locking system having an engagement member, the engagement member having a cam follower cammingly engaging a first detent formed on the linkage system when the primary locking system is in the retaining position preventing the primary locking system from moving from the retaining position, the second locking system configured to be actuatable to disengage the cam follower from the first detent prior to movement of the primary locking system from the retaining position.

2. The toggle clamp according to claim 1 wherein the cam follower of the engagement member cammingly engaging a second detent formed on the linkage system when the primary locking system is in the release position preventing the primary locking system from moving from the release position, the second locking system configured to be actuatable to disengage the cam follower from the second detent prior to movement of the primary locking system from the release position.

3. The toggle clamp according to claim 2 wherein the second detent is formed on the linkage system of the primary locking system.

4. The toggle clamp according to claim 3, further comprising a cam surface extending between the first detent and the second detent, the cam follower cammingly engaging the cam surface.

5. The toggle clamp according to claim 4 wherein the engagement member is spring biased such that the cam follower engages the first detent, the second detent, and the cam surface.

6. The toggle clamp according to claim 1 wherein the linkage system comprises a clamp link extending from the handle member to the clamp, the first detent being formed on the clamp link.

7. The toggle clamp according to claim 1 wherein the engagement member is linearly coupled to the handle member.

8. The toggle clamp according to claim 1 wherein the engagement member is biased such that the cam follower engages the first detent.

9. The toggle clamp according to claim 1 wherein the engagement member is pivotally coupled to the handle member.

10. The toggle clamp according to claim 9 wherein the engagement member comprises a pivot at a first end and the cam follower is disposed at an opposing second end.

11. The toggle clamp according to claim 10 wherein the engagement member comprises a gripping portion extending from a midpoint section between the first end and the second end.

12. The toggle clamp according to claim 9 wherein the engagement member comprises a pivot at a midpoint section between opposing ends thereby forming a cantilevered shape.

13. A toggle clamp for selectively coupling a work piece, the toggle clamp comprising:

a base structure;

a primary locking system configured to be movable between a retaining position and a release position, the primary locking system having a handle member pivotally coupled to the base structure, a clamp for engaging the workpiece in the retaining position and releasing the workpiece in the release position, and a linkage system mechanically interconnecting the handle member with the clamp, the linkage system being pivotally coupled to each of the handle member and the clamp; and a second locking system having a linear engagement member, the linear engagement member having a cam follower cammingly engaging a first detent formed on the linkage system when the primary locking system is in the retaining position preventing the primary locking system from moving from the retaining position, the second locking system configured to be actuable to disengage the cam follower from the first detent prior to movement of the primary locking system from the retaining position, wherein the linear engagement member is linearly coupled to the handle member and linearly captured within a slot formed in the handle member.

14. The toggle clamp according to claim 13 wherein the linear engagement member comprises a gripping portion extending through the slot formed in the handle member.

15. The toggle clamp according to claim 13 wherein the cam follower of the linear engagement member cammingly engaging a second detent formed on the linkage system when the primary locking system is in the release position preventing the primary locking system from moving from the release position, the second locking system configured to be actuatable to disengage the cam follower from the second detent prior to movement of the primary locking system from the release position.

16. The toggle clamp according to claim 15 wherein the second detent is formed on the linkage system of the primary locking system.

17. The toggle clamp according to claim 16, further comprising a cam surface extending between the first detent and the second detent, the cam follower cammingly engaging the cam surface.

18. The toggle clamp according to claim 17 wherein the linear engagement member is biased such that the cam follower engages the first detent, the second detent, and the cam surface.

19. The toggle clamp according to claim 13 wherein the linkage system comprises a clamp link extending from the handle member to the clamp, the first detent being formed on the clamp link.

20. The toggle clamp according to claim 13 wherein the linear engagement member is biased such that the cam follower engages the first detent.

21. A toggle clamp for selectively coupling a work piece, the toggle clamp comprising:

a base structure;

a primary locking system movable between a retaining position and a release position, the primary locking system having a handle member pivotally coupled to the base structure, a clamp for engaging the workpiece in the retaining position and releasing the workpiece in the release position, and a linkage system mechanically interconnecting the handle member with the clamp, the linkage system being pivotally coupled to each of the handle member and the clamp, the linkage system having a first detent, a second detent, and a cam surface formed therebetween; and a second locking system having an engagement member, the engagement member having a cam follower cammingly engaging the first detent when the primary locking system is in the retaining position preventing the primary locking system from moving from the retaining position and engaging the second detent when the primary locking system is in the release position preventing the primary locking system from moving from the release position, the second locking system configured to be actuatable to disengage the cam follower from the first detent and the second detent prior to movement of the primary locking system.

22. The toggle clamp according to claim 21 wherein the engagement member is biased such that the cam follower engages the first detent, the second detent, and the cam surface.

23. The toggle clamp according to claim 21 wherein the engagement member is linearly coupled to the handle member, the engagement member is linearly captured within a slot formed in the handle member.

24. The toggle clamp according to claim 21 wherein the engagement member is pivotally coupled to the handle member.

25. The toggle clamp according to claim 24 wherein the engagement member comprises a pivot at a first end and the cam follower is disposed at an opposing second end.

26. The toggle clamp according to claim 24 wherein the engagement member comprises a pivot at a midpoint section between opposing ends thereby forming a cantilevered shape.

* * * * *